US006670753B1

(12) United States Patent
Hatano

(10) Patent No.: US 6,670,753 B1
(45) Date of Patent: Dec. 30, 2003

(54) FLAT PANEL DISPLAY WITH GETTERING MATERIAL HAVING POTENTIAL OF BASE, GATE OR FOCUS PLATE

(75) Inventor: Yasuhito Hatano, San Jose, CA (US)

(73) Assignees: Sony Corporation (JP); Sony Electronics, Park Ridge, NJ (US)

( * ) Notice: Subject to any disclaimer, the term of this patent is extended or adjusted under 35 U.S.C. 154(b) by 219 days.

(21) Appl. No.: 09/619,026

(22) Filed: Jul. 19, 2000

(51) Int. Cl.[7] ..... H01J 17/24

(52) U.S. Cl. ..... 313/553; 313/495; 313/496; 313/497; 313/558

(58) Field of Search ..... 313/553, 495, 313/496, 497, 547, 549, 558

(56) References Cited

U.S. PATENT DOCUMENTS

| | | | | |
|---|---|---|---|---|
| 5,223,766 A | * | 6/1993 | Nakayama et al. | 313/309 |
| 5,283,500 A | * | 2/1994 | Kochanski | 313/306 |
| 5,502,348 A | * | 3/1996 | Moyer et al. | 257/10 |
| 5,545,946 A | | 8/1996 | Wiemann et al. | 313/497 |
| 5,835,991 A | * | 11/1998 | Niiyama et al. | 313/422 |
| 5,883,467 A | * | 3/1999 | Chalamala et al. | 313/553 |
| 5,977,706 A | | 11/1999 | Cho et al. | 313/553 |
| 5,994,833 A | * | 11/1999 | Seko et al. | 313/309 |
| 6,005,335 A | * | 12/1999 | Potter | 313/309 |

FOREIGN PATENT DOCUMENTS

| | | | |
|---|---|---|---|
| JP | 09245616 | 9/1997 | H01J/7/18 |

* cited by examiner

*Primary Examiner*—Nimeshkumar D. Patel
*Assistant Examiner*—Sikha Roy
(74) *Attorney, Agent, or Firm*—Rader, Fishman & Grauer PLLC

(57) ABSTRACT

A flat panel display is provided including a baseplate for carrying a first potential, the baseplate having emitters for emitting electrons positioned thereon and a faceplate for carrying a second potential, the faceplate having phosphors thereon. The baseplate and the faceplate are hermetically sealed around the periphery to define an evacuated volume. A gate electrode for carrying a third potential causes the emitter to selectively emit electrons, which cause the phosphors to emit light and which ionize contaminant gases in the evacuated volume. A gettering material is disposed in housing connected to the evacuated volume and has a getter connection connecting the gettering material to the baseplate for applying the first potential to the gettering material, which causes the ionized contaminant gases to be attracted to and absorbed by the gettering material. The getter connection extends outside the vacuum to allow for testing of the ionized contaminant gases.

21 Claims, 3 Drawing Sheets

FLAT PANEL DISPLAY WITH GETTERING MATERIAL HAVING POTENTIAL OF BASE, GATE OR FOCUS PLATE

TECHNICAL FIELD

The present invention relates generally to flat panel displays and more particularly to flat panel displays with gettering systems which assist in evacuating and maintaining the evacuation of flat panel displays.

BACKGROUND ART

Cathode-ray tube (CRT) displays have been the predominant display technology for purposes such as home television and computer systems. For many applications, CRTs have advantages in terms of superior color resolution, high contrast and brightness, wide viewing angles, fast response times, and low manufacturing costs. However, CRTs also have major drawbacks such as excessive bulk and weight, fragility, high power and voltage requirements, strong electromagnetic emissions, the need for implosion and x-ray protection, undesirable analog device characteristics, and a requirement for an unsupported vacuum envelope that limits screen size.

To address the inherent drawbacks of CRTs, alternative display technologies have been developed. These technologies generally provide flat panel displays, and include liquid crystal displays (LCDs), both passive and active matrix, electroluminescent displays (ELDs), plasma display panels (PDPs), vacuum fluorescent displays (VFDs) and field emission displays (FEDs).

The FED offers great promise as an alternative flat panel display technology. Its advantages include low cost of manufacturing as well as the superior optical characteristics generally associated with the CRT display technology. Like CRTs, FEDs are phosphor based and rely on cathodoluminescence as a principle of operation. FEDs rely on electric field or voltage induced emissions to excite the phosphors by electron bombardment rather than the temperature induced emissions used in CRTs. To produce these emissions, FEDs have generally used row-and-column addressable cold cathode emitters of which there are a variety of designs, such as point emitters (also called cone, microtip, or "Spindt" emitters), wedge emitters, thin film amorphic diamond emitters, and thin film edge emitters.

Each of the FED emitters is typically a miniature electron gun of micron dimensions. When a sufficient voltage is applied between the emitter and an adjacent gate, electrons are emitted from the emitter into a vacuum which is located between a baseplate, upon which the emitters are mounted, and a faceplate having a transparent anode surface to which the phosphors are applied. The emitters are biased as cathodes and the emitted electrons are attracted and accelerated to strike the phosphors on the anode surface. The phosphors then emit visible light which form picture elements, or pixels, which make up the images on the face of the FED.

Electron emissions in FEDs require a hard vacuum to avoid serious problems, such as vacuum degradation, emission current degradation, and/or plasma generation or ionization which can lead to non-uniform brightness of the display or shortening of the working life of the display.

The FED is conventionally hermetically sealed in air and then evacuated through a tube which is pinched or melted shut after evacuation in a process called "tubulation". To assist in the evacuation process and to maintain the hard vacuum, a "gettering material" is used which absorbs contaminant gases by various chemical reactions. There are basically two different types of gettering materials. One type is an evaporable gettering material, which is capable of being deposited by an evaporative deposition process. The other type is a non-evaporable gettering material, which is formed into the configuration in which it will be used. Non-evaporable getters are manufactured in various geometries, such as metal wires or strips covered by a porous coating of gettering material.

One approach of using an evaporable gettering material is to deposit it in the portion of the tube between the flat panel display and the pinch or melt point of the tubulation process. This has the disadvantage of the tube being accidentally broken off during the handling which accompanies manufacturing.

Another approach is simply forming an evaporable getter at a location along the interior surface of baseplate or/and faceplate. This is disadvantageous because a getter typically needs a substantial amount of surface area to perform the gas collection function. However, it is normally important that the ratio of active display area to the overall interior surface area be quite high in an FED. Because an evaporable getter is formed by evaporative deposition, a substantial amount of inactive area along the interior surface of the baseplate or/and the faceplate structure would normally have to be allocated for a getter, thereby significantly reducing the active-to-overall area ratio. In addition, the active components of the FED easily become contaminated during the gettering material deposition process and some of the active FED components could become short-circuited.

A non-evaporable getter is an alternative to an evaporable getter. A non-evaporable getter typically consists of a pre-fabricated unit. As a result, the likelihood of damaging the components of an FED during the installation of a non-evaporable getter into the FED is considerably lower than with an evaporable getter. While a non-evaporable getter does require substantial surface area, the pre-fabricated nature of a non-evaporable getter generally allows it to be placed closer to the actual display elements than an evaporable getter.

For flat panel displays with both these gettering systems, it has been determined that certain gases remain and are difficult to remove by the gettering system even after long periods of time. Knowing that the contaminant gases cause severe problems, those skilled in the art have long sought a system by which the gettering effect could be improved, but they have been unsuccessful.

DISCLOSURE OF THE INVENTION

The present invention provides a flat panel display having a cathode carrying baseplate hermetically sealed to an anode-coated, phosphor-bearing, faceplate with a vacuum between the baseplate and the faceplate. Electron emitters are mounted on the baseplate in contact with the cathode and a gettering material is disposed in a housing open to the vacuum and adjacent to the baseplate. The gettering material is conductively connected to the cathode on the baseplate to charge the gettering material to attract contaminant gas ions so that they can be absorbed by the gettering materials to maintain the vacuum.

The present invention provides a flat panel display having a cathode carrying baseplate hermetically sealed to an anode-coated, phosphor-bearing, faceplate. A vacuum is located between the baseplate and the faceplate. Electron emitters connected to the cathode are mounted on the baseplate and a gettering material is disposed in a housing open to the vacuum and adjacent to the faceplate. The gettering material is conductively connected to the cathode on the baseplate by a conductive connection which extends outside the vacuum to allow checking the quantity of residual gas ions present in the vacuum.

The above and additional advantages of the present invention will become apparent to those skilled in the art from a reading of the following detailed description when taken in conjunction with the accompanying drawings.

DESCRIPTION OF THE PREFERRED EMBODIMENT

Figure 1:
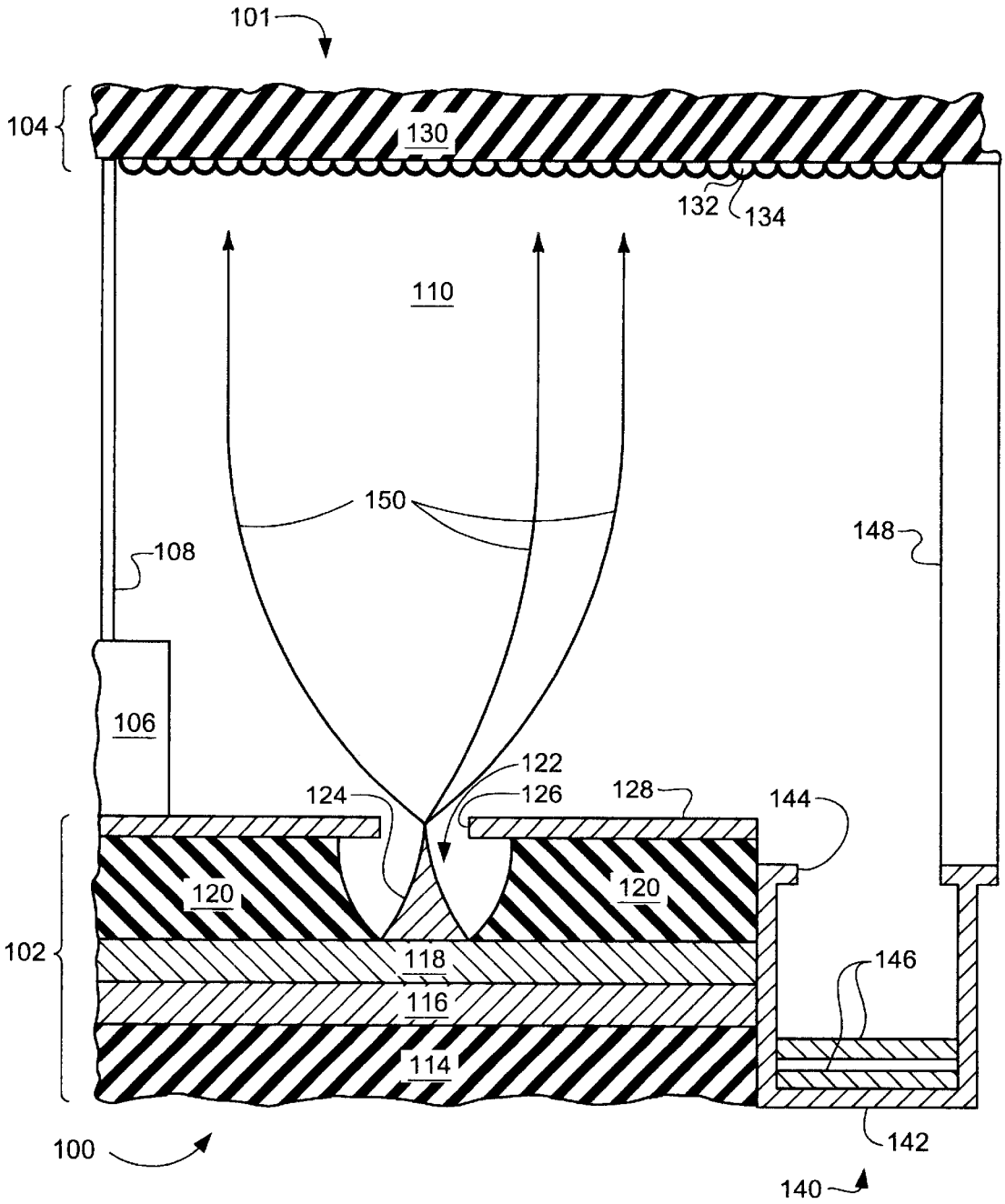
FIG. 1 (PRIOR ART)
FIG. 1 (PRIOR ART) is a close-up cross section of a field emission display for a single picture element.

Referring now to FIG. 1 (PRIOR ART), therein is shown a close-up cross section of a portion of a flat panel display, such as a field emission display (FED) 100 for a single picture element, or pixel 101. The FED 100 includes a baseplate 102 and a faceplate 104 separated by a focus plate 106 and a wall spacer 108 and surrounded by a hermetic seal 148. The space between the baseplate 102 and the faceplate 104 is a hard vacuum 110 of about $10^{-7}$ torr containing traces of contaminant gases (not shown).

The baseplate 102 includes an insulating plate 114 upon which a base electrode, or conductive "row" electrode 116, has been deposited. A resistive layer 118 is deposited on the conductive row electrode 116 and is covered by an insulating layer 120 which has a cavity 122 formed therein. Inside the cavity 122 is an electron emissive element such as an emitter 124. The emitter 124 is deposited on the resistive layer 118 in the cavity 122 and is concentric with holes 126 patterned into an upper base electrode or conductive column electrode of which a portion is designated as a gate electrode 128. The gate electrode 128 is deposited over the insulating layer 120 and is connected to a column electrode (not shown).

The faceplate 104 includes a transparent plate 130 of a material, such as glass or plastic, coated with phosphors 132 having a thin electrode 134 of a material such as aluminum deposited on the phosphors 132.

A gettering system 140 is positioned adjacent the baseplate 102. Those skilled in the art would understand that the gettering system could be in any position, and could be of any configuration. The gettering system 140 includes a housing 142 having an opening 144 connected to the vacuum 110. Gettering material 146 is disposed in the housing 142. Examples of gettering materials are aluminum (Al), barium (Ba), cobalt (Co), chromium (Cr), iron (Fe), manganese (Mn), nickel (Ni), tantalum (Ta), titanium (Ti), vanadium (V), tungsten (W), combinations thereof, and compounds thereof.

In operation, the baseplate 102 is charged to become the cathode and the faceplate 104 is charged to become the anode. More specifically, a negative voltage is imposed on the conductive row electrode 116. The negative voltage is imposed through the resistive layer 118 to the emitter 124. A positive voltage is imposed on the thin electrode 134. When a suitable voltage, generally around 10 volts less negative than the negative voltage on the emitter 124, is applied to the gate electrode 128, the emitter 124 emits electrons into the vacuum 110 at various angles. The emitted electrons, under the influence of electric fields from the focus plate 106, follow parabolic trajectories indicated by the lines 150 to impact on the thin electrode 134, which has the anode voltage impressed upon it. The phosphors 132 behind the thin electrode 134 struck by the emitted electrons will produce light of a color consistent with a particular phosphor selected. The light will be for one picture element, or pixel 101.

Figure 2:
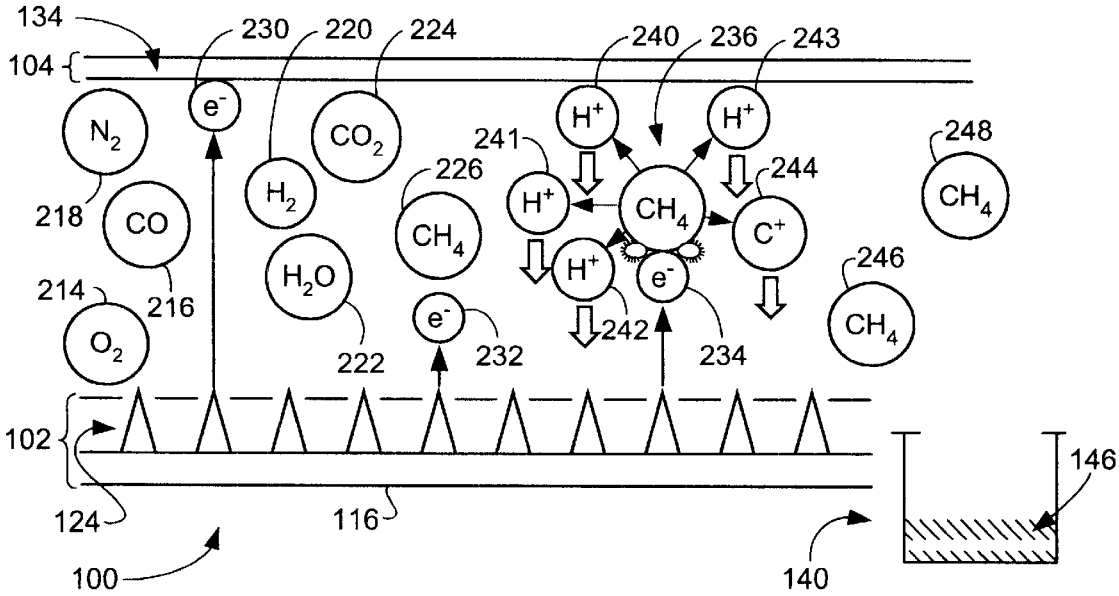
FIG. 2 (PRIOR ART)
FIG. 2 (PRIOR ART) is a schematic cross section of a field emission display having a housing containing gettering material.

Referring now to FIG. 2 (PRIOR ART), therein is shown a schematic of a FED 100 with the baseplate 102, the faceplate 104, the emitters 124, the gettering system 140, and the gettering material 146. Between the baseplate 102 and the faceplate 104 are shown various contaminant gases which remain after the hard vacuum of the vacuum 110 is formed. Representative gases are oxygen ($O_2$) 214, carbon monoxide (CO) 216, nitrogen ($N_2$) 218, hydrogen ($H_2$) 220, vaporous water ($H_2O$) 222, carbon dioxide ($CO_2$) 224, and methane ($CH_4$) 226.

Also shown are electrons 230, 232, and 234 being emitted from the emitters 124. The electron 230 is shown striking the thin electrode 134 on the faceplate 104. The electron 232 is shown striking the $CH_4$ molecule 226. The electron 234 is shown striking and breaking a $CH_4$ molecule 236 into hydrogen ions ($H^+$) 240–243 and a carbon ($C^{+)}$ ion 244. The $H^+$ions 240–243 and the $C^+$ 244 have positive charges and are attracted towards the negatively charged, cathode, or the baseplate 102 as indicated by the wide arrows. After accumulating near the baseplate 102, the ions will recombine to form a $CH_4$ molecule 246. A $CH_4$ molecule 248 indicates that recombined molecules having a neutral charge will again enter the vacuum 110 to cause various previously enumerated problems. Due to its neutral charge, the $CH_4$ molecule 248 may or may not enter the gettering system 140 since it will move randomly.

In the past, a common gettering material 146 was barium (Ba), which absorbs various contaminant gases to maintain the vacuum 110 during the life of the FED 100 through the following series of reactions:

Phase 1:

$$2Ba+O_2 \leftrightarrows 2BaO$$

$$3Ba+2CO \leftrightarrows 2BaO+BaC_2$$

$$3Ba+N_2 \leftrightarrows Ba3N_2$$

$$Ba+H_2 \leftrightarrows BaH_2$$

$$Ba+H_2O \leftrightarrows BaO+H_2\uparrow \qquad \text{Equation 1}$$

$$5Ba+2CO_2 \leftrightarrows 4BaO+BaC_2$$

. . . etc.

Phase 2:

$$BaO+CO_2 \leftrightarrows BaCO_3$$

$$BaO+H_2O \leftrightarrows Ba(OH)_2$$

$$BaC_2+H_2O \leftrightarrows BaO+C_2H_2\uparrow \qquad \text{Equation 2}$$

$$2BaH_2+O_2 \leftrightarrows 2BaO+2H_2\uparrow$$

$$Ba_3N_2+3H_2O \leftrightarrows 3BaO+2NH_3\uparrow$$

. . . etc.

Phase 3:

$$Ba(OH)_2+CO_2 \leftrightarrows BaCO_3+H_2\uparrow$$

. . . etc.

During life testing of the FED 100, it was found that the life expectancy was disproportionately shorter for the flat panel displays which ran 6 kV than the flat panel displays that run at 4 kV. An explanation of this shortening is that life expectancy is proportional to emission current from the emitter, which depends on work functions. The work functions are based on the intensity of the electric field on top of the emitters and the pressure in the flat panel displays. It is believed that the emission currents, and thus life expectancy, are decreased by ion sputters of contaminant gases (the force of each ion impact is based on f=EQ where f is force, E is the electric field, and Q is the electric charge of the ion), which soften the vacuum in the FED 100. It also appears that detrimental arcing increases where there are contaminant ions in the FED 100.

In investigating further into the types of contaminant gases which might be present, it was discovered that $CH_4$ appeared as a contaminant gas over the life of the flat panel display. The source of this contaminant gas was unclear, but it appeared that the gettering material 146 was not absorbing $CH_4$ in sufficient quantities to remove it from the vacuum 110 during the life of the FED 100.

Figure 3:
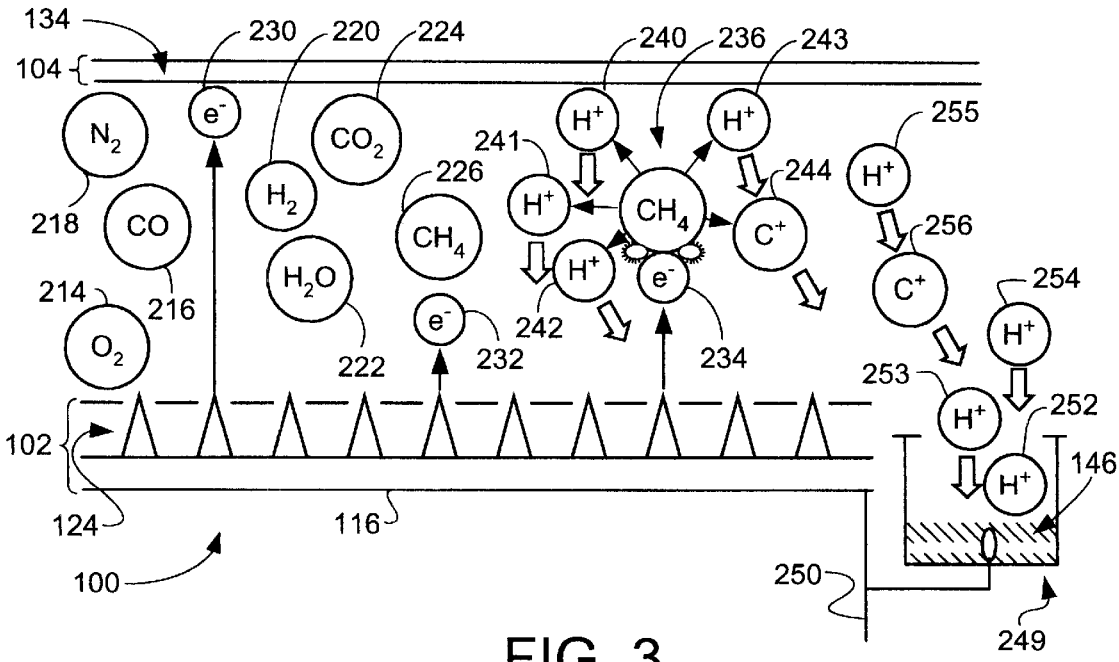
FIG. 3 is a schematic cross section of a field emission display having a gettering material charged in accordance with the present invention.

Referring now to FIG. 3, therein is shown the same structure as shown in FIG. 2 (PRIOR ART) with the same numbers being used to designate the same elements. Of particular interest is the $CH_4$ As previously mentioned, the source of this contaminant gas was unclear.

In examining the various chemical reactions in the three Phases above, and in particular the reactions indicated by Equations 1 and 2, it appeared that Ba functions as a catalyst to make $CH_4$ from $CO_2$, CO, and $H_2O$ by the reactions:

$$Ba+H_2O \leftrightarrows BaO+H_2\uparrow \qquad \text{Equation 1}$$

$$BaC_2+H_2O \leftrightarrows BaO+C_2H_2\uparrow \qquad \text{Equation 2}$$

$$C_2H_2+3H_2 \rightarrow 2CH_4\uparrow \qquad \text{Equation 3}$$

Basically, two of the reactions produce $H_2$ gas and $C_2H_2$ gas, which combine to produce $CH_4$ as shown in Equation 3. Further, in none of the reactions of Phases 1–3 does $CH_4$ gas combine with the Ba in the gettering material 146 so as to be absorbed. Thus, even if the $CH_4$ gas migrated into the gettering system 140 of FIG. 2, it would not be removed from the vacuum 110.

After much analysis it was realized that, if the $CH_4$ molecule 226 could be ionized into $C^+$ ion 244 and $H^+$ ions 240–243 by electron impact, the $C^+$ ion 244 and $H^+$ ions 240–243 might be absorbed by the gettering material 146. However, the difficulty is that the $C^+$ and $H^+$ ions tend to recombine into $CH_4$ before reaching the gettering material 146 in the gettering system 140 of FIG. 2 (PRIOR ART).

The above analysis led to the further realization that the gettering system 140 was electrically neutral and, by charging the gettering system 140 to form a charged gettering system, it would be possible to attract ions, such as $C^+$ ion 244 and $H^+$ ions 240–243, as indicated by the broad arrows, to the vicinity of the gettering material 146 where it could be absorbed. It was further deemed that adding the charge directly to the gettering material 146 would further assure absorption by attracting the positively charged ions into direct contact with the negatively charged gettering material 146.

The charge could be applied as a voltage from the FED power supply (not shown) through a conductive connection 250 to the gettering material 146 in the charged gettering system 249.

As shown in FIG. 3, when the conductive connection 250 is in operation, the gettering material 146 will have a negative charge, which causes positive ions, such as $H^+$ ions 252–255 and $C^+$ ion 256, to be attracted into the gettering system 249 to be absorbed by the gettering material 146 before it can recombine into $CH_4$.

The above arrangement has been determined to be extremely efficacious in removing the $CH_4$ gases from the vacuum 110 in the FED 100.

As would be evident to those skilled in the art, the above arrangement will work for any positively charged ion resulting from the ionization of any of the other gases. This renders the vacuum 110 of the present invention even harder than that of the conventional flat panel display with regard to other gases than the $CH_4$ gas, which is used as an example above.

Figure 4:
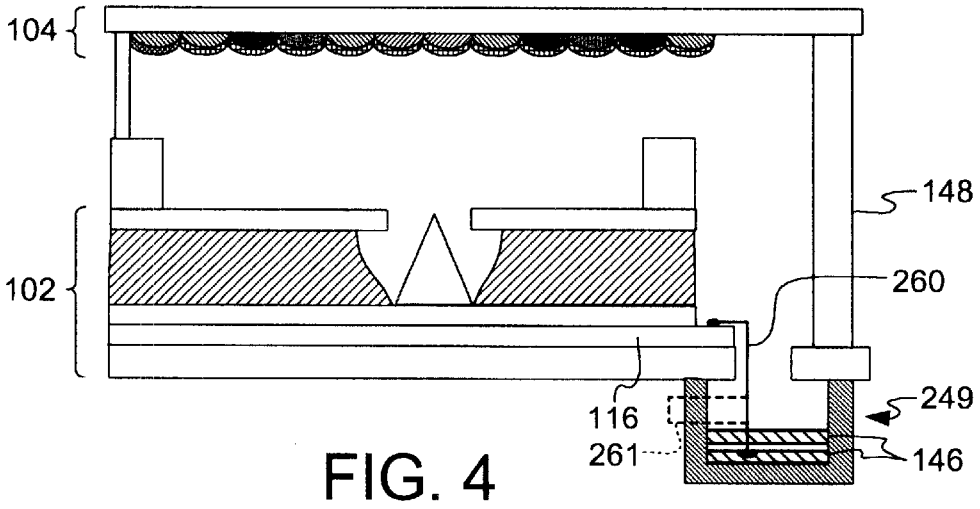
FIG. 4 is a schematic cross section of a field emission display having a gettering material connected to an electrode in accordance with the present invention.

Referring now to FIG. 4, therein is shown schematic cross section of a preferred embodiment of the FED 100 having the gettering material 146 connected to the lower base electrode 116 by a conductive connection 260.

An additional advantage of the present invention may be obtained by extending a conductive connection 261 (shown as an alternative connection by the dotted line) outside of the FED 100 where it may be accessed for testing purposes to determine the real time hardness of the vacuum 110 for quality control and life test purposes. This feature was previously not obtainable.

Figure 5:
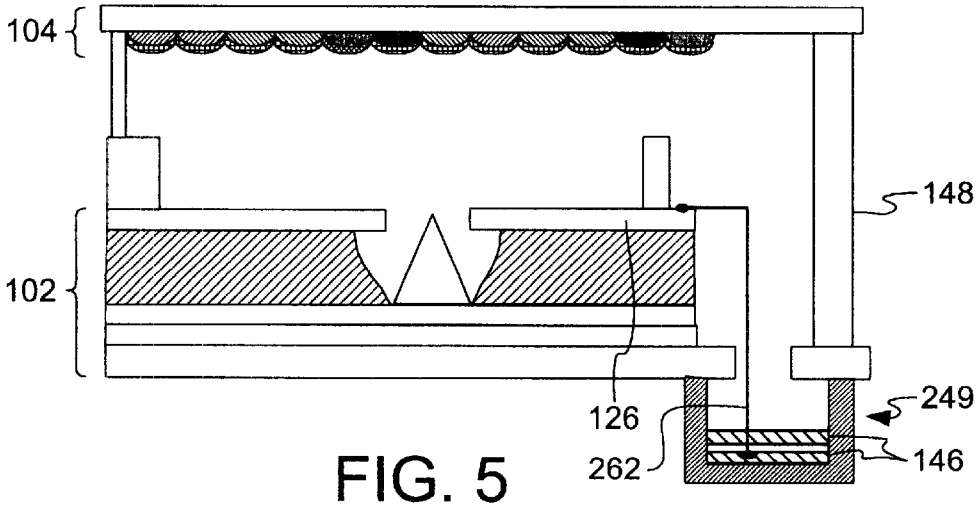
FIG. 5 is a schematic cross section of a field emission display having a gettering material connected to a gate electrode in accordance with the present invention.

Referring now to FIG. 5, therein is shown a schematic cross section of the FED 100 having the gettering material 146 connected in an alternate embodiment to the gate electrode 126 by a conductive connection 262. The gate electrode 126 is not as highly charged as the conductive row electrode 116, but may be easier to access in some designs.

Figure 6:
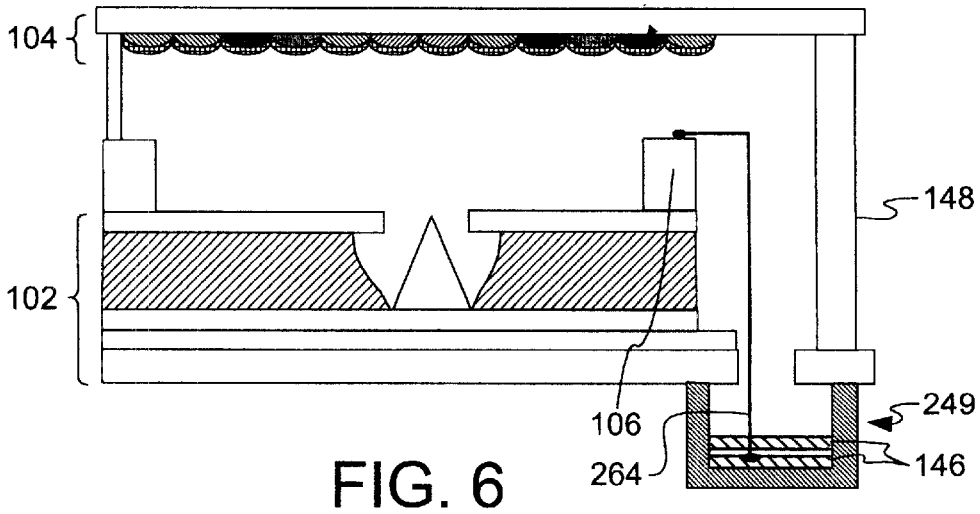
FIG. 6 is a schematic cross section of a field emission display having a gettering material connected to a focus plate in accordance with the present invention.

Referring now to FIG. 6, therein is shown a schematic cross section of the FED 100 having the gettering material 146 connected in an alternate embodiment to the focus plate 106 by a conductive connection 264. The focus plate 106 may be the easiest to access for making the conductive connection 264.

It will be understood that the terms "row" and "column" may be interchanged and the terms "upper" and "lower" are used just as a matter of convenience and may be different based on the orientation of the FED 100.

While the invention has been described in conjunction with a specific best mode, it is to be understood that many alternatives, modifications, and variations will be apparent to those skilled in the art in light of the aforegoing description. Accordingly, it is intended to embrace all such alternatives, modifications, and variations which fall within the spirit and scope of the included claims. All matters set forth herein or shown in the accompanying drawings are to be interpreted in an illustrative and non-limiting sense.

The invention claimed is:

1. A flat panel display comprising:

a baseplate including: an insulating plate, a row electrode disposed over the insulating plate for carrying a first potential, an emitter over the row electrode for emitting electrons, and a column-connected gate electrode for selectively carrying a second potential and causing the emitter to selectively emit electrons;

a faceplate including: a transparent plate, phosphors disposed on the transparent plate; and an electrode disposed over the phosphors for carrying a third potential whereby the electrons strike the electrode to cause emission of light from the phosphors;

a hermetic seal cooperating with the faceplate and the baseplate to define an evacuated volume whereby electrons in said evacuated volume ionize contaminant gases in the evacuated volume;

a housing adjacent to the baseplate;

a gettering material disposed in the housing and exposed to the evacuated volume;

a first getter connection for connecting the row electrode to the gettering material for applying at least a portion of the first potential to the gettering material whereby the ionized contaminant gases are attracted to the gettering material and absorbed thereby; and a second getter connection for extending the first getter connection outside the vacuated volume between the baseplate and the housing.

2. The flat panel display as claimed in claim 1 wherein the first getter connection is connected between the base electrode and the gettering material.

3. The flat panel display as claimed in claim 1 wherein the first getter connection is connected between the gate electrode and the gettering material.

4. The flat panel display as claimed in claim 1 including a focus plate over the gate electrode and wherein the first getter connection is connected between the focus plate and the gettering material.

5. The flat panel display as claimed in claim 1 wherein: the gettering material is selected from a group of materials consisting of aluminum (Al), barium (Ba), cobalt (Co), chromium (Cr), iron (Fe), manganese (Mn), nickel (Ni), tantalum (Ta), titanium (Ti), vanadium (V), tungsten (W), combinations thereof, and compound thereof.

6. A method for manufacturing a flat panel display comprising the steps of:

providing a baseplate including: an insulating plate, a lower electrode disposed over the insulating plate, an emitter over the lower electrode for emitting electrons, and a gate electrode;

providing a faceplate including: a transparent plate, phosphors disposed over the transparent plate, and an electrode associated with the phosphors and the transparent plate whereby the electrons attracted to the electrode to cause the phosphors to emit light;

hermetically sealing the faceplate and the baseplate to define an evacuated volume;

providing a housing adjacent to the baseplate;

providing a gettering material disposed in the housing and exposed to the evacuated volume;

providing a first getter connection for connecting the baseplate to the gettering material;

applying a first potential to the lower electrode;

applying a second potential to the upper electrode;

applying a third potential to the gate electrode whereby the emitter begins emitting electrons to ionize contaminant gases in the evacuated volume;

applying at least a portion of the potential of the baseplate to the gettering material whereby the ionized contaminant gases are attracted to the gettering material and absorbed thereby; and providing a second getter connection for extending the first getter connection outside the evacuated volume between the baseplate and the housing.

7. The method as claimed in claim 6 wherein the step of providing the first getter connection includes making a getter connection between the base electrode and the gettering material.

8. The method as claimed in claim 6 wherein the step of providing the first getter connection includes making a getter connection between the gate electrode and the gettering material.

9. The method as claimed in claim 6 further comprising the step of: providing a focus plate over the gate electrode and wherein the step of providing the first getter connection includes making a getter connection between the focus plate and the gettering material.

10. The method as claimed in claim 6 wherein the step of providing the gettering material provides a gettering material selected from a group of materials consisting of aluminum (Al), barium (Ba), cobalt (Co), chromium (Cr), iron (Fe), manganese (Mn), nickel (Ni), tantalum (Ta), titanium (Ti), vanadium (V), tungsten (W), combinations thereof, and compound thereof.

11. A method for manufacturing a flat panel display comprising the steps of:

providing a baseplate including: an insulating plate, a row electrode disposed over the insulating plate, an emitter over the row electrode for emitting electrons, and a column-connected gate electrode;

providing a faceplate including: a transparent plate, a transparent electrode disposed over the transparent plate, and phosphors disposed on the transparent electrode whereby the electrons strike the phosphors to cause emission of light therefrom;

hermetically sealing the faceplate and the baseplate to define an evacuated volume;

providing a gettering material exposed to the evacuated volume; and providing a first getter connection for connecting the row electrode to the gettering material;

applying a negative voltage to the row electrode;

applying a positive voltage to the transparent electrode;

applying an intermediate voltage to the gate electrode whereby the emitter begins emitting electrons to ionize contaminant gases in the evacuated volume;

applying at least the negative voltage to the gettering material whereby the ionized contaminant gases are attracted to the gettering material and absorbed thereby; and providing a second getter connection for extending the first getter connection outside the evacuated volume between the baseplate and the housing.

12. The method as claimed in claim 11 wherein the step of providing the first getter connection includes making a getter connection between the base electrode and the gettering material.

13. The method as claimed in claim 11 wherein the step of providing the first getter connection includes making a getter connection between the gate electrode and the gettering material.

14. The method as claimed in claim 11 further comprises the step of: providing a focus plate over the gate electrode and wherein the step of providing the first getter connection includes making a getter connection between the focus plate and the gettering material.

15. The method as claimed in claim 11 wherein the step of:

providing the gettering material provides a gettering material selected from a group of materials consisting of aluminum (Al), barium (Ba), cobalt (Co), chromium (Cr), iron (Fe), manganese (Mn), nickel (Ni), tantalum (Ta), titanium (Ti), vanadium (V), tungsten (W), combinations thereof, and compound thereof.

16. A flat panel display comprising:

a baseplate including: an insulating plate, a base electrode disposed over the insulating plate, an emitter over the base electrode for emitting electrons, and a gate electrode for causing the emitter to selectively emit electrons;

a face plate including: a transparent plate, phosphors associated with the transparent plate; and an electrode associated with the phosphors and the transparent plate;

a hermetic seal cooperating with the faceplate and the baseplate to define an evacuated volume;

a housing adjacent to the baseplate;

a gettering material disposed in the housing and exposed to the evacuated volume; and a first getter connection for applying voltage on the base electrode to the gettering material, whereby ionized contaminant gases in the evacuated volume are attached to the gettering material and absorbed thereby; and a second getter connection for extending the first getter connection outside the evacuated volume between the baseplate and the housing.

17. The flat panel display as claimed in claim 16 wherein the gettering material is selected from a group of materials consisting of aluminium (Al), barium (Ba), cobalt (Co), chromium (Cr), iron (Fe), manganese (Mn), nickel (Ni), tantalum (Ta), titanium (Ti), vanadium (V), tungsten (W), combinations thereof, and compounds thereof.

18. A flat panel display comprising:

a baseplate including: an insulating plate, a base electrode disposed over the insulating plate, an emitter over the base electrode for emitting electrons, and a gate electrode for causing the emitter to selectively emit electrons;

a faceplate including: a transparent plate, phosphors associated with the transparent plate; and an electrode associated with the phosphors and the transparent plate;

a hermetic seal cooperating with the faceplate and the baseplate to define an evacuated volume;

a housing adjacent to the baseplate;

a gettering material disposed in the housing and exposed to the evacuated volume;

a first getter connection for applying voltage on the gate electrode to the gettering material, whereby ionized contaminant gases in the evacuated volume are attached to the gettering material and absorbed thereby; and a second getter connection for extending the first getter connection outside the evacuated volume between the baseplate and the housing.

19. The flat panel display as claimed in claim 18 wherein the gettering material is selected from a group of materials consisting of aluminium (Al), barium (Ba), cobalt (Co), chromium (Cr), iron (Fe), manganese (Mn), nickel (Ni), tantalum (Ta), titanium (Ti), vanadium (V), tungsten (W), combinations thereof, and compounds thereof.

20. A flat panel display comprising:

a baseplate including; an insulating plate, a base electrode disposed over the insulating plate, an emitter over the base electrode for emitting electrons, and a gate electrode for causing the emitter to selectively emit electrons; and a focus plate over the gate electrode;

a faceplate including: a transparent plate, phosphors associated with the transparent plate; and an electrode associated with the phosphors and the transparent plate;

a hermetic seal cooperating with the faceplate and the baseplate to define an evacuated volume;

a housing adjacent to the baseplate;

a gettering material disposed in the housing and exposed to the evacuated volume;

a first getter connection for applying voltage on the focus plate to the gettering material whereby ionized contaminant gases in the evacuated volume are attached to the gettering material and absorbed thereby; and a second getter connection for extending the first getter connection outside the evacuated volume between the baseplate and the housing.

21. The flat panel display as claimed in claim 20 wherein the gettering material is selected from a group of materials consisting of aluminium (Al), barium (Ba), cobalt (Co), chromium (Cr), iron (Fe), manganese (Mn), nickel (Ni), tantalum (Ta), titanium (Ti), vanadium (V), tungsten (W), combinations thereof, and compounds thereof.

* * * * *